United States Patent [19]

Michelsen et al.

[11] Patent Number: 5,016,826

[45] Date of Patent: May 21, 1991

[54] TUBE MILL PARTITION

[75] Inventors: Ralph Michelsen, Eschede; Udo Schulze-Brockhausen, Everswinkel; Herbert Weit; Erwin Schmitz, both of Beckum, all of Fed. Rep. of Germany

[73] Assignee: Christian Pfeiffer Maschinenfabrik GmbH & Co., KG, Beckum, Fed. Rep. of Germany

[21] Appl. No.: 464,134

[22] Filed: Jan. 16, 1990

[30] Foreign Application Priority Data

Mar. 2, 1989 [DE] Fed. Rep. of Germany ..... 3903255

[51] Int. Cl.[5] ..... B02C 17/18

[52] U.S. Cl. ..... 241/72; 241/171; 241/179

[58] Field of Search ..... 241/54, 70, 71, 72, 241/91, 171, 176, 179, 180, 181

[56] References Cited

U.S. PATENT DOCUMENTS

| | | | |
|---|---|---|---|
| 1,440,002 | 12/1922 | Bradley | 241/176 X |
| 1,769,823 | 7/1930 | Born | 241/176 |
| 2,405,059 | 7/1946 | Schmel | 241/176 X |

FOREIGN PATENT DOCUMENTS

| | | | |
|---|---|---|---|
| 1065015 | 1/1984 | U.S.S.R. | 241/176 |

*Primary Examiner*—Timothy V. Eley

*Attorney, Agent, or Firm*—Fleit, Jacobson, Cohn, Price, Holman & Stern

[57] ABSTRACT

The invention relates to a tube mill partition as a transfer or discharge partition. With a view to reducing wear and facilitating maintenance, separate wearing beams are used and the latter or the slotted plates can be easily replaced without any further assembly opening.

12 Claims, 2 Drawing Sheets

TUBE MILL PARTITION

BACKGROUND OF THE INVENTION

The invention relates to tube mill partition as a transfer or discharge wall, with a front slotted wall and a downstream positioned, substantially closed rear wall, the slotted and rear walls in each case having a ring segmental construction with a central, axially substantially closed air passage opening and with roughly radially oriented lifting blades between the slotted wall and the rear wall and at least the slotted wall has radially several ring segments of slotted plates.

Such tube mill partitions or dividing walls are generally known, reference being e.g. made to U.S. Pat. No. 3,964,717.

The partitions conventionally comprise a front, upstream slotted wall and a downstream rear wall, which is substantially closed in the present case. Between the slotted wall and the rear wall extends in the central region an air passage opening, which is substantially closed for axially guiding the air flow. The internal area between the slotted wall and the rear wall and in which are fitted the lifting blades for the material being ground, is consequently difficult of access from the assembly and maintenance standpoints.

Thus, hitherto an at least partial disassembly of the central air flow duct or the central part of the partition has been necessary, in order to obtain access to the inside of the slotted and rear walls, which in particular was necessary in the case of screw fastenings of individual ring segments of the walls. These assembly problems were particularly pronounced when there was a need to replace individual slotted plates due to wear.

The problem of the present invention is to design a tube wall partition as a transfer or discharge wall and in particular the slotted wall thereof, with improved protection against wear and with easier assembly and maintenance.

SUMMARY OF THE INVENTION

According to the invention this problem is solved in that in the high wear area between the slotted plates are provided roughly radially oriented wearing beams, which project at least slightly out of the plane of the slotted wall and that at least the screw fastenings ending in the inner area of the partition with nuts for the slotted plates and the wearing beams are equipped with a rotation locking means and a raisable axial locking means.

An essential point of the invention is to equip the walls and in particular the slotted wall with several, radially associated, segmented wall rings. As a result of this construction it is e.g. possible to have different radial extensions of the wall rings and to in planned manner adapt the ring segments or slotted plates to the amount of wear. As the maximum wear areas are roughly known to the Expert as a result of the material being ground, the grinding ball size and the further parameters of the precise intended use of a tube mill, e.g. the slotted plates of the radial central ring can have a radial size roughly corresponding to the maximum wear area. Thus, this measure makes it possible to replace only the slotted plates of the central ring after a corresponding operating period, without affecting the outer or inner ring of the slotted wall.

As an important factor of the wear to the slotted plates and which similarly applies with regards to the rear wall plates, results from an impact of the grinding balls and material of the roughly "kidney-shaped", raised grinding material—ball filling, wearing beams are fitted roughly in the radial direction between the slotted plates and they project over the surface of the corresponding wall. These wearing beams, which have a repelling function particularly for the grinding balls, are preferably fitted between the most wear affected slotted plates. The wearing beams can be positioned between successive slotted plates or also several circumferentially following slotted plates.

In the simplest configuration these wearing beams have in axial section a roughly rectangular shape and are made from a hard, wear-resistant material. It is also possible to adopt other shapes, e.g. with an inclined surface for better repelling the grinding material and balls.

Compared with the extension of the individual slotted plates, the wearing beams are circumferentially kept relatively narrow and are mainly fitted along the lifting blades fixed in the partition. They can best be fixed with a break-away screw passing from the slotted wall to the rear wall and which is provided with a nut on the rear wall side. The term breaking-away screw is understood to mean a screw with e.g. a hexagon head, which on tightening the screw with a corresponding torque is twisted off and a circular counterbore head as the head of the screw remains in a corresponding counterbore hole, e.g. of the wearing beam.

Although on the rear wall side comparable and similar problems exist to those on the slotted wall side, the solution according to the invention is discussed relative to the slotted wall.

In spite of the fact that the slotted wall plates are normally constituted by armour plates and appropriately are made from a tough, breaking-resistant material, after a corresponding operating time it is necessary to carry out a replacement, particularly in the maximum wear area.

Hitherto the replacement and the refitting of a single worn slotted plate has taken place through the burning out of the corresponding counterbore head of the fastening screw and by driving or knocking through the bolt, including the rear nut into the interior of the partition. It has therefore been necessary for fixing a new slotted plate to so fix the corresponding nut on the rear wall of the mounting flange of the lifting blades by means of a portable tool via an opening in the central air passage, that an axial moving aside or a turning of the nut during the screwing in of the break-away screw from the front of the slotted wall is prevented. In the case of larger partition diameters of e.g. approximately 5 m, a considerable disassembly effort and expenditure was involved in order to be able to carry out such a nut fixing.

The invention adopts the procedure of fixing the nuts on the inside of the corresponding wall structure or mounting flange of a lifting blade in cage-like manner. This appropriately takes place with a polygonal bush adapted to the nut contour, which is e.g. spotwelded to the mounting flange. This secures the nut against turning. For axial securing purposes preferably a plastic or wire pin is inserted into the bush at right angles to the direction of the screw. The nut is inserted in the bush and secured in pin-like manner.

An individual slotted plate is then fixed in the conventional manner from the front thereof by means of a corresponding break-away screw, the nut being positioned in secured manner on the back of the slotted wall. As a result of this stationary mounting of the nut, there is no need to disassemble adjacent plates or even the central part with the central air opening.

The bush and pin for mounting the nut can also be in the form of a cage or e.g. two wires fitted in bow-like manner to the inside of the mounting flange. However, the pin or wire thickness must be such that it is easy to axially drive through the bolt with the nut. When the worn slotted plate is removed, it is then possible by means of this exposed area to again mount the nut on the inside of the mounting flange, e.g. by welding and to retain the corresponding nut in cage-like manner therein.

The radial curvature of the lifting blades also helps to reduce wear and an axial slope is also preferred. As a result of this axial slope, it is ensured that the grinding material which has entered the partition is passed rapidly from the inside of the slotted wall towards the inside of the rear wall and consequently the material flow to the latter is aided. Moreover, as a result of this rapid grinding material removal, the risk of the clogging of the slots in the slotted wall is reduced. In conjunction with the radially present arcuate structure, which assists the removal of the grinding material in the axial region, it is possible to reduce the wearing effect on the inside of the slotted wall. The arcuate structure is particularly advantageous in the case of difficultly flowing grinding materials, the stability of the partition construction being improved by the divergence from the strictly radial constructional principle.

In order to simplify the constructional principle of the partition flange areas extending roughly surface-parallel to the slotted wall are preferably provided on the axial marginal areas of the lifting blades. These flange areas are appropriately adapted to the corresponding fixing areas. Together with the corresponding flange areas, which are at least present on the front, the lifting blades form a unit, which can be jointly installed. In the vicinity of said flange areas are fixed both the plates of the slotted and rear walls, as well as the wearing beams. These mounting flanges consequently permit a relatively flexible plate distribution, which is desirable in order to improve the stability.

The wearing beams are preferably arranged in the vicinity of the main wearing zones in the radial direction of the corresponding plate edge. Their fixing is brought about with bolts extending through to the rear wall for increasing the stability of the partition. As it can be assumed that the rear wall will be accessible, there is no need to have a corresponding nut mounting there. However, if account is taken of a more frequent replacement of the wearing beams, it is also appropriate to have there a slotted wall side fixing with a short break-away screw and a nut mounting.

As a result of the installation of such wearing beams a functional separation is achieved on the slotted wall between the actual material transfer through the slotted wall into the next chamber and the wearing forces necessarily acting on the slotted wall and which are now primarily absorbed by the wearing beams. Thus, different materials can be used for the slotted plates and the wearing beams. Another cost effect results from the reduced material volume of the wearing beams which are wear-prone parts.

As a result of the inventive concept maintenance becomes easy, whilst cost savings result from the planned design of the essential wear-prone zones with wearing beams.

BRIEF DESCRIPTION OF THE DRAWINGS

The invention is described in greater detail hereinafter relative to an embodiment and the attached drawings, wherein show.

DETAILED DESCRIPTION

Figure 2:
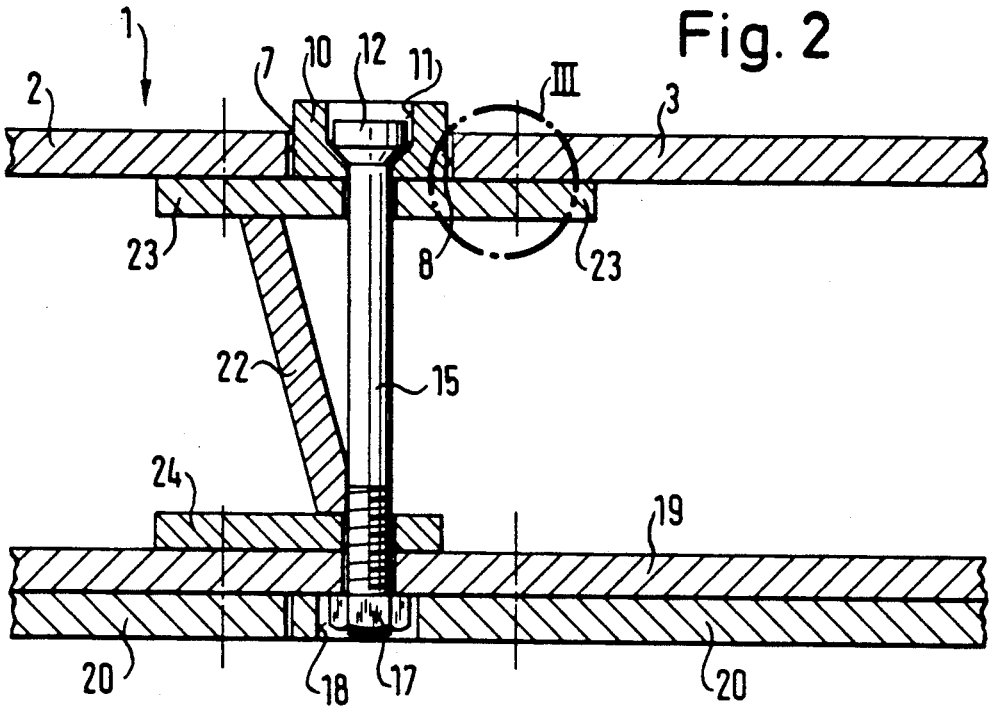
FIG. 2 An axial section through area II—II of FIG. 1 with the representation of a rear wall detail.
Figure 1:
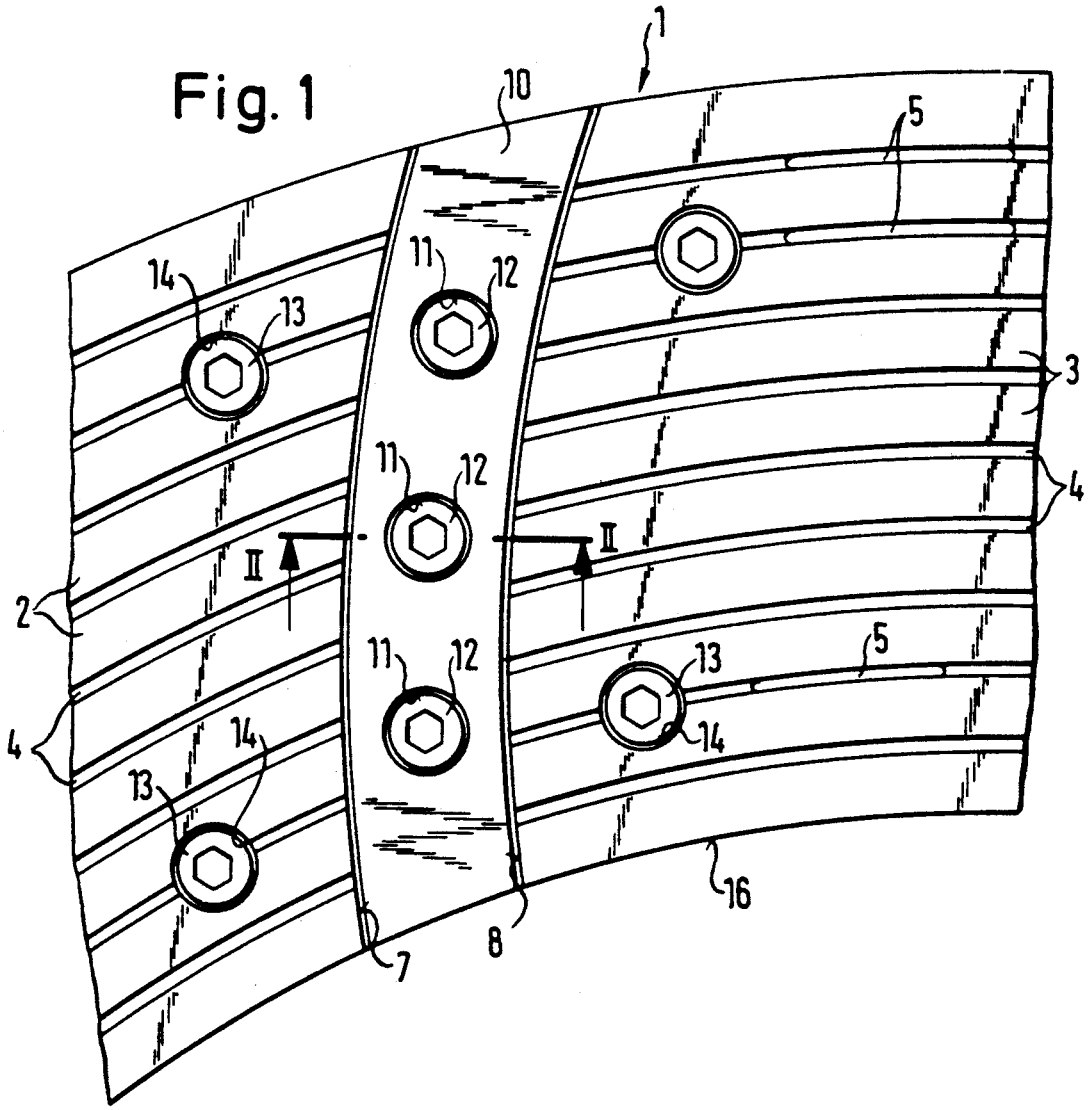
FIG. 1 An axial plan view of a fragmentary area of a slotted wall with an e.g. central ring segment, in which a wearing beam is provided between adjacent slotted wall plates.

FIG. 1 shows in fragmentary form a slotted wall, e.g. with a central ring segment 1 in plan view and in the flow direction. The central ring segment 1, which can be followed to the radial inside and radial outside by identically constructed segments, has two arcuate slotted plates 2 and 3. Between the facing edges 7, 8 of said slotted plates 2, 3 are located a wearing beam 10, whose radial size corresponds to that of the slotted plates 2, 3. Thus, the plate edge 16 passes in aligned manner into the marginal area of the wearing beam 10.

In the depressions 4 of the grate-shaped slotted plates 3 are only shown a few exemplified, circumferentially directed, elongated openings 5, which are used for the through-flow of the correspondingly comminuted grinding material.

With reference to the sectional representation along line II—II in FIG. 1 the wearing beam 10 made from hard, wear-resistant material is fixed by means of an upper mounting flange 23 and a lower mounting flange 24 via a bolt-like break-away screw 15 to the rear wall 20 or in a corresponding recess 18 therein against a wall structure 19 connected thereto. The through bolt consequently contributes to the stability of the correspondingly constructed tube mill partition. In the example according to FIG. 1 three bolts with their counterbore heads 12 are used for fixing the wearing beam 10. The sectionally approximately parallelipipedic wearing beam 10 carries on the slotted wall side a counterbore hole 11 in which engages the corresponding head 12 with screw 15.

Slotted plates 2, 3 are fixed with similar break-away screws 25 (FIG. 3) against the flange fixtures 23 of the lifting blades 22. Adjacent to the wearing beam 10 e.g. two break-away screws 25 are used for fixing the slotted plate 3.

Figure 3:
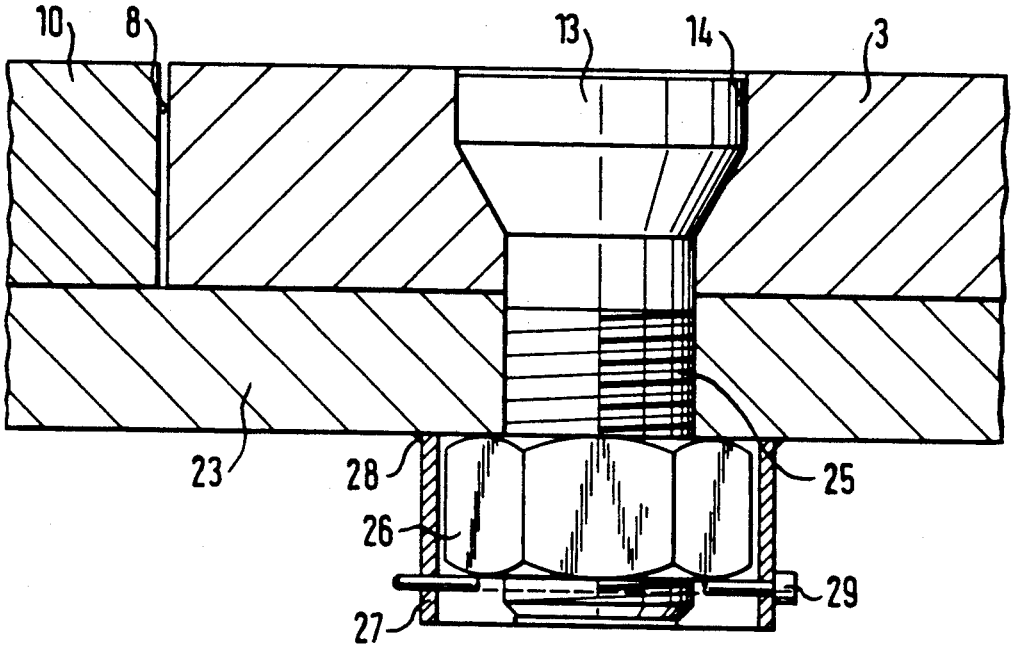
FIG. 3 A larger-scale view of area III in FIG. 2 with a break-away screw and nut mounting on the inside.
Figure 4:
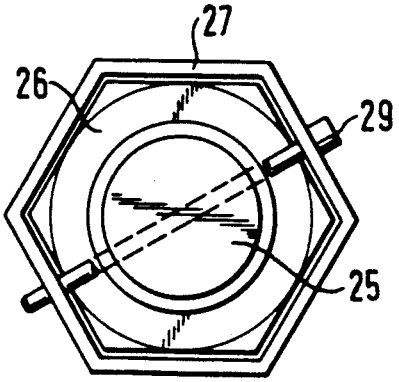
FIG. 4 A plan view of the nut mounting in FIG. 3 from the bottom.

In the larger-scale view according to FIG. 3 the counterbore head 13 of break-away screw 25 is positively engaged in the counterbore hole 14 of a slotted plate. On the inside, in FIG. 3 the lower face of the mounting flange 23, is provided a cage-like bush 27, which is e.g. welded at 28. Spot or multispot welding is sufficient for this. During assembly firstly said bush 27 is fixed to the mounting flange. The nut 26 is then inserted into it and mounted in cage-like manner therein by a pin 29 at right angles to the axis, which prevents turning or axial displacement of the nut.

The thus mounted nut 26 can then be easily fixed from the front of the slotted wall and without it being necessary to hold the nut with a tool in the interior of the partition.

The e.g. plastic pin 29 is generally broken during screwing, which is indicated by the interrupted line. At the latest at the time of the disassembly of the slotted plate 3 and after burning out the corresponding counterbore head 13 of break-away screw 25, by axially exerting force and driving through the bolt, the axial locking provided by pin 29 is destroyed. The bush 27 is obviously adapted to the outer contour of the nut used.

The use of wearing beams 10 consequently leads to a reduction in the wear, e.g. in the case of slotted plates. In view of the easy maintenance mounting, it is relatively easy to replace individual slotted plates without it being necessary to have large assembly openings in the partition.

What is claimed is:

1. In a tube mill partition having a front slotted wall functioning for discharge or transfer and a substantially closed rear wall positioned downstream of the front slotted wall, the slotted and rear walls in each case having a ring segmental construction with a central, axially substantially closed air passage opening and with substantially radially oriented lifting blades between the slotted wall and the rear wall and at least the slotted wall has radially disposed ring segments of slotted plates, the improvement comprising radially oriented wearing beams provided in high wear areas between the slotted plates which project at least slightly out of a plane containing the slotted wall and screw fastenings for fastening the slotted plates and the wearing beams, each screw fastening being equipped with a rotation locking means for preventing rotation and axial locking means for preventing axial displacement.

2. In a tube mill partition according to claim 1, the further improvement of the wearing beams being made from hardened steel.

3. In a tube mill partition according to claim 1, the further improvement of the rotation and axial locking means is in the form of a nut cage and is fixed to the inside of the slotted wall.

4. In a tube mill partition according to claim 1, the further improvement of the rotation locking means constituted by a polygonal bush adapted to a nut contour and which is fixed to the inside of the slotted wall.

5. In a tube mill partition according to claim 1, the further improvement of the axial locking means being constructed as a pin received in the rotation locking means at right angles to the axis of the screw fastening.

6. In a tube mill partition according to claim 1, the further improvement of the wearing beams being also provided on the rear wall.

7. In a tube mill partition according to claim 1, the further improvement of the wearing beams being fixed in the vicinity of mounting flanges of the lifting blades with the screw fastenings passing through to the rear wall.

8. In a tube mill partition according to claim 1, the further improvement of the screw fastenings having on the slotted wall side break-away screws as hexagon head screws.

9. In a tube mill partition according to claim 1, the further improvement of the lifting blades being at least radially arcuate and have ring segments on the slotted wall and rear wall side as mounting flanges.

10. In a tube mill partition according to claim 1, the further improvement of the radial marginal areas of the slotted plates and wearing beams being adapted to the arcuate configuration of the lifting blades.

11. In a tube mill partition according to claim 1, the further improvement of the lifting blades sloping in the axial direction.

12. In a tube mill partition according to claim 4, the further improvement of the screen fastening includes a nut that is welded.

* * * * *